US006467504B1

(12) United States Patent
Bonicontro

(10) Patent No.: US 6,467,504 B1
(45) Date of Patent: Oct. 22, 2002

(54) N CONNECTION

(76) Inventor: Nataniel Carli Bonicontro, Rua Padre João Barbreri, 216 ap 601, Jandaia do Sul, PR (BR)

( * ) Notice: Subject to any disclaimer, the term of this patent is extended or adjusted under 35 U.S.C. 154(b) by 0 days.

(21) Appl. No.: 09/346,892

(22) Filed: Jul. 2, 1999

(51) Int. Cl.[7] ..... B08B 9/053
(52) U.S. Cl. ..... 137/599.14; 137/601.2
(58) Field of Search ..... 137/599.14, 601.2

(56) References Cited

U.S. PATENT DOCUMENTS 3,444,724 A * 5/1969 Gilpin ..... 137/599.13 X
5,257,537 A * 11/1993 Bianchi ..... 73/197
5,421,813 A * 6/1995 Ohnishi ..... 604/4
5,435,338 A * 7/1995 Silva et al. ..... 137/242
5,437,302 A * 8/1995 Silva et al. ..... 137/242

* cited by examiner

*Primary Examiner*—Stephen M. Hepperle

(57) ABSTRACT

An "N" connection allows any cleaning device or pig to pass through pipe lines without interfering with fluid flow and without interrupting the flow in the branch line. In the "N" connection a branch line is connected to the main flow line through two connections, each connection having a check valve. As the pig passes over each connection, fluid flow through the other connection keeps the pig moving through the main line so that the device does not become lodged in the branch line.

1 Claim, 1 Drawing Sheet

N CONNECTION

BRIEF SUMMARY OF THE INVENTION

The claimed invention refers to the development of an "N" connection, to be used in pipe networks, allowing the passage of any cleaning device, or pig, to be used without interfering with fluid flow in either the main pipe line or a branch line. Further, the claimed invention also makes possible a double flow direction.

Pipe networks which are used for fluid flow often consist of a main tube or pipe and branches of pipe line attached to the main pipe through pipe line connectors. Such pipe line connectors may consist of "T" sections, "Y" sections, double "T" junctions, saddles, collars, rings, or other components. The purpose of these connectors is to make deviations from the main pipe or from branch pipes in order to change the flow path, with an aim to divide the main flow or return the flow, for example.

One problem associated with using a "T" style connector in a pipe line system is that it is difficult to use cleaning devices , such as spheres, pigs and foam-pigs, in the pipe line. The most affected are foam-pigs, because they have a low moment of inertia and low mechanical resistance. To pass a foam-pig through the main pipe line of a "T" connector, it is necessary to close the branch line or in some way interrupt the fluid flow through the branch. Otherwise, the foam-pig would become lodged in the connector, damaging the pig and impairing the cleaning operation.

The claimed invention, the "N" connection, is designed to solve these problems associated with the cleaning of pipe lines having "T" style connectors. The "N" connection allows the passage of any cleaning device in pipe lines, without interfering with the main flow and without interrupting the flow in the branch line, so that even a double flow direction is possible. In the "N" connection, a branch line connects to the main flow line through two paths or connections, each connection having a check valve. As the pig passes over the first connection, fluid continues to flow through the second connection so that the pig continues to move through the main line and does not become lodged in the branch line. Similarly, as the pig passes over the second connection, the fluid flow through the first connection keeps the pig moving through the main line so it does not become lodged in the branch line. Thus, movement of the pig through the main line is accomplished without interrupting flow through either the main line or the branch line, and without damaging the pig or impairing the cleaning operation.

BRIEF DESCRIPTION OF THE DRAWINGS

A preferred embodiment of the claimed invention is shown in FIGS. 1 and 2. So that the construction details of the "N" connection may be clearly understood and may be utilized by any person skilled in the art, it shall be described in a clear, brief and objective way, on the basis of these drawings of the proposed invention, such an embodiment consisting of a basic model. However, the claimed invention shall not be considered as restricted to the embodiment presented in the drawings, as there may be other conceptions and/or variances, keeping the same distinctive functional features of this basic invention.

DETAILED DESCRIPTION OF THE INVENTION

Figure 1:
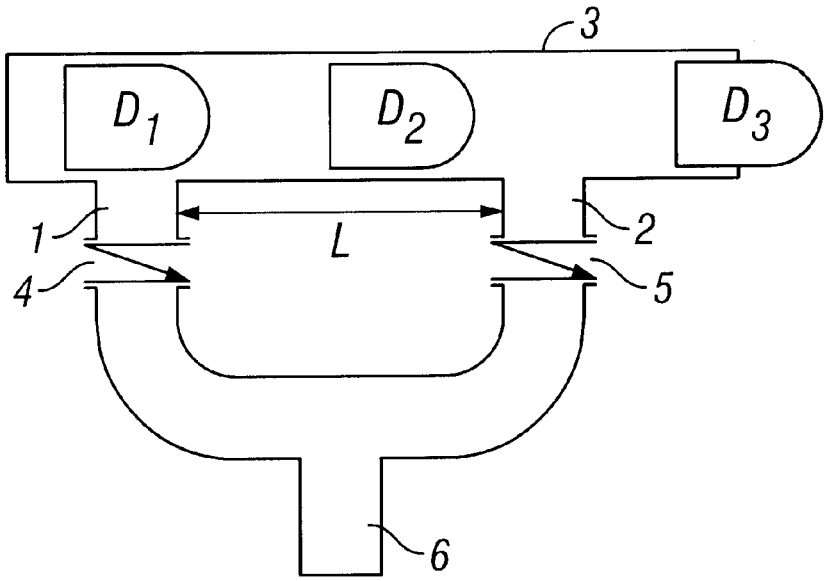
FIG. 1 shows a branch from the main pipe line, showing the double connection of the claimed invention to the main line, and showing the passage of the pig through the main line.

FIG. 1 shows the preferred embodiment of the claimed invention, "N" connection, with the branch line (6) connected to the main pipe line (3) through two connections (1 and 2), each of which connection (1 and 2) has a check valve (4 and 5). When the cleaning device or pig is in position DI, directly over the first connection (1), the second connection (2) guarantees the flow of fluid to the branch line (6), the fluid flow maintaining the displacement speed of the device. When the pig is in position D2, between the two connections (1 and 2), fluid flow occurs through both the first connection (1) and the second connection (2) to the branch line (6). The fluid flow through the first connection (1) and the main line (3) keeps the device moving past the second connection (2) to continue moving past the "N" connection to position D3 in the main line (3). To maintain flow to the branch line (6) while the pig is passing the two connections (1 and 2) in the "N" connection through the main line (3), the distance "L" between the two valves (4 and 5) must be larger than the length of the device or pig used.

Figure 2:
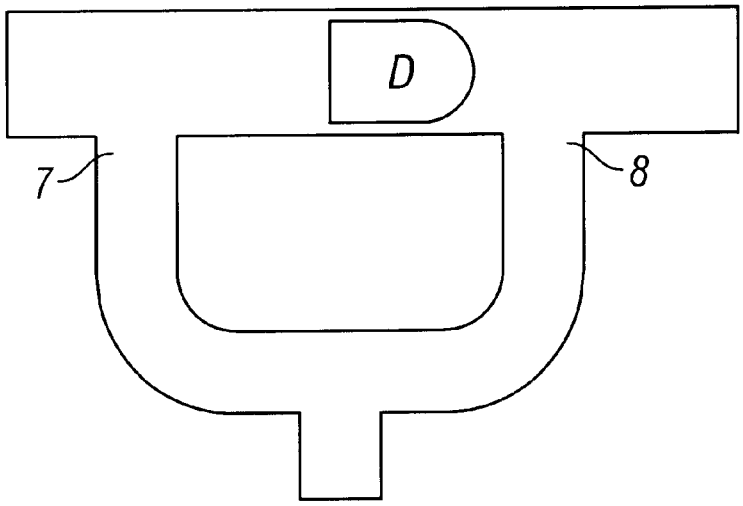
FIG. 2 shows how the check valves may block the flow of the fluid from the main pipe line through the branch line, stopping the cleaning device or pig between the two connections.

FIG. 2 shows how the check valves control the flow of fluid through the branch line, thus keeping the device D from stopping between the two connection points (7 and 8) of the branch line to the main line.

The improvements of the "N" connection offer several advantages over a standard "T" style connection:

- It is not necessary to interrupt the fluid flow through the branch line when the foam-pig passes through the main pipe line;
- The ease of the cleaning operation of the pipe line networks;
- It permits the passage of any style of cleaning device without interfering with the main flow;
- It permits double flow direction;
- It increases the useful life span of foam-pigs by keeping them from becoming damaged because of lodging in branch lines.

What is claimed is:

1. An "N" connection piping arrangement in a pipe network comprising a branch line splitting into two connection lines, an upstream connection line and a downstream connection line, said upstream connection line and said downstream connection line running parallel to each other, each of said two connection lines connecting to a main line, each of said two connecting lines having a check valve such that a fluid flow through said two connection lines continues through said branch line through said downstream connection line when a cleaning device is in position to obstruct said fluid flow through said upstream connection line, and such that said fluid flow continues through both of said two connection lines when said cleaning device is in position between said two connections in said main tubing, said fluid flow maintaining the displacement speed of said cleaning device, and wherein the distance between said upstream connection line and said downstream connection line of said "N" connection is larger than the length of said cleaning device used.

* * * * *